US005722543A

United States Patent [19]

Jarmuzewski

[11] Patent Number: 5,722,543

[45] Date of Patent: Mar. 3, 1998

[54] GOLF BALL SIZING APPARATUS

[75] Inventor: Mario Jarmuzewski, Chicopee, Mass.

[73] Assignee: Lisco, Inc., Tampa, Fla.

[21] Appl. No.: 521,859

[22] Filed: Aug. 31, 1995

[51] Int. Cl.[6] ..... B07C 5/00

[52] U.S. Cl. ..... 209/559; 209/644; 209/911; 209/925; 209/932

[58] Field of Search ..... 209/44.2, 559, 209/625, 644, 659, 906, 911, 922, 925, 932, 562, 563, 564

[56] References Cited

U.S. PATENT DOCUMENTS

| | | | |
|---|---|---|---|
| 2,405,829 | 8/1946 | Hurley, Jr. | 209/644 |
| 4,806,279 | 2/1989 | Ramm | 209/922 X |
| 5,609,173 | 3/1997 | Hollrock | 209/677 X |

FOREIGN PATENT DOCUMENTS

| | | | |
|---|---|---|---|
| 8901832 | 3/1989 | WIPO | 209/644 |

*Primary Examiner*—Tuan Nguyen

[57] ABSTRACT

An apparatus is provided for separating a flow of golf balls into a first set of golf balls which meet predetermined specifications and a second set of golf balls which do not meet specifications. The apparatus includes a first elongated cylinder having a central axis positioned at an angle with respect to the horizontal. The elongated cylinder has an open lower end, an open upper end and an interior diameter to allow for the rolling of golf balls of the first set to move therethrough and out of the lower end. A large aperture is formed in an upper surface of the elongated cylinder at a central extent thereof. The interior surface of the elongated cylinder is of an increased diameter between central extent thereof and the upper end thereof. A supplemental small aperture is formed in the upper surface of the elongated cylinder offset from the uppermost extent thereof. The supplemental small aperture is formed at an angle with regard to the axis of the elongated cylinder. A short delivery cylinder is provided having a vertical axis and being formed with a lower end coupled to the large aperture and an upper end for delivering golf balls to be separated.

3 Claims, 3 Drawing Sheets

GOLF BALL SIZING APPARATUS

BACKGROUND OF THE INVENTION

1. Field of the Invention

The present invention relates to golf ball sizing apparatus and, more particularly, pertains to separating a flow of golf balls into a first set of golf balls which meet predetermined specifications including size, burrs, blisters and long gates and a second set of golf balls which do not meet specifications.

2. Description of the Prior Art

The use of devices for sizing golf balls of various designs and configurations is known in the prior art. More specifically, devices for sizing golf balls of various designs and configurations heretofore devised and utilized for the purpose of separating golf balls according to various specifications through any of a number of methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,354,379 to Miner, discloses methods and apparatus for testing roundness and straightness of pipes and tubings.

U.S. Pat. No. 4,385,447 to Bennett discloses a golf ball sphericity gauge.

U.S. Pat. No. 4,528,759 to Joyce discloses a golf ball gauge.

U.S. Pat. No. 3,310,879 to Brzesinski discloses a golf ball sphericity gauge and utility tool.

U.S. Pat. No. 3,574,260 to Suyk discloses a golf ball sphericity gauge and putting device.

U.S. Pat. No. 3,797,123 to Fraley discloses a portable precision golf ball sphericity gauge.

U.S. Pat. No. 3,828,442 to Bernard discloses a golf ball sphericity gauge.

British Patent Number 159,447 to Cochrane et al. discloses a dimension and weight gauge for golf balls and the like.

Japanese Patent Number 131787 discloses a tiltable chamber for plasma treating golf balls.

S.U. Patent Number 1747864 discloses measuring a cylindrical article 8 bypassing it into a gauge until it is jammed.

Japanese Patent Number 56-168109 discloses the use of sound waves to detect unevenness on the surface of a golf ball.

In this respect, the golf ball sizing apparatus according to the present invention substantially departs from the conventional concepts and designs of the prior art, and in so doing provides an apparatus primarily developed for the purpose of separating a flow of golf balls into a first set of golf balls which meet predetermined specifications including size, burrs, blisters and long gates and a second set of golf balls which do not meet specifications.

Therefore, it can be appreciated that there exists a continuing need for new and improved golf ball sizing apparatus which can be used for separating a flow of golf balls into a first set of golf balls which meet predetermined specifications including size, burrs, blisters and long gates and a second set of golf balls which do not meet specifications. In this regard, the present invention substantially fulfills this need.

SUMMARY OF THE INVENTION

In view of the foregoing disadvantages inherent in the known types of devices for sizing golf balls of various designs and configurations now present in the prior art, the present invention provides an improved golf ball sizing apparatus. As such, the general purpose of the present invention, which will be described subsequently in greater detail, is to provide a new and improved golf ball sizing apparatus and method which has all the advantages of the prior art and none of the disadvantages.

To attain this, the present invention essentially comprises an apparatus for separating a flow of golf balls into a first set of golf balls which meet predetermined specifications including size, burrs, blisters and long gates and a second set of golf balls which do not meet specifications comprising, in combination a first elongated cylinder having a primary axis positioned at an angle of about 10 degrees with respect to the horizontal, the elongated cylinder having an open lower end and an open upper end and having an interior diameter of about 2.25 inches to allow for the rolling of golf balls of the first set to move therethrough and out of the lower end, a large aperture formed in an upper surface of the elongated cylinder at a central extent thereof to form a long lower region and a short upper region, the interior surface of the elongated cylinder being of an increasing diameter from the central extent thereof to the upper end thereof, a pair of supplemental small apertures formed in the upper surface of the elongated cylinder offset from the uppermost region thereof, the supplemental small apertures being formed at an angle of 30 degrees with regard to the axis of the elongated cylinder; a short delivery cylinder having a vertical axis and having an diameter of about 2.76 inches and being formed with a lower end coupled to the large aperture of the elongated cylinder and having an upper end with a flange for coupling with a machine for delivering at a predetermined feed rate golf balls to be separated; a ramp for the delivering of golf balls into the delivery cylinder a source of compressed air coupled to the small apertures adapted to inject a stream of air into the elongated cylinder in a direction toward the upper end of the elongated cylinder to drive a golf ball of the second set in the elongated cylinder outwardly of the elongated cylinder; and a sensor adjacent to the output end of the elongated cylinder to sense the flow of golf balls of the first set through the lower end of the elongated cylinder and to activate the source of compressed air in the event that a golf ball of the second set does not move through the lower end of the elongated cylinder in a timely manner to thereby drive such golf ball out of the upper end.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf ball sizing apparatus which has all the advantages of the prior art devices for sizing golf balls of various designs and configurations and none of the disadvantages.

It is a further object of the present invention to provide a new and improved golf ball sizing apparatus which allows for the flow of golf balls which meet certain predetermined specifications but which reject golf balls which do not meet such specifications.

Still another object of the present invention is to separate a flow of golf balls into a first set of golf balls which meet predetermined specifications including size, burrs, blisters and long gates and a second set of golf balls which do not meet specifications.

Lastly, it is an object of the present invention to provide new and improved apparatus for separating a flow of golf balls into a first set of golf balls which meet predetermined specifications and a second set of golf balls which do not meet specifications comprising a first elongated cylinder having a central axis positioned at an angle with respect to the horizontal, the elongated cylinder having an open lower end and an open upper end and having an interior diameter to allow for the rolling of golf balls of the first set to move therethrough and out of the lower end, a large aperture formed in an upper surface of the elongated cylinder at a central extent thereof, the interior surface of the elongated cylinder being of an increased diameter between central extent thereof and the upper end thereof, a supplemental small aperture formed in the upper surface of the elongated cylinder offset from the uppermost extent thereof, the supplemental small aperture being formed at an angle with regard to the axis of the elongated cylinder; a short delivery cylinder having a vertical axis and being formed with a lower end coupled to the large aperture and an upper end for delivering golf balls to be separated.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
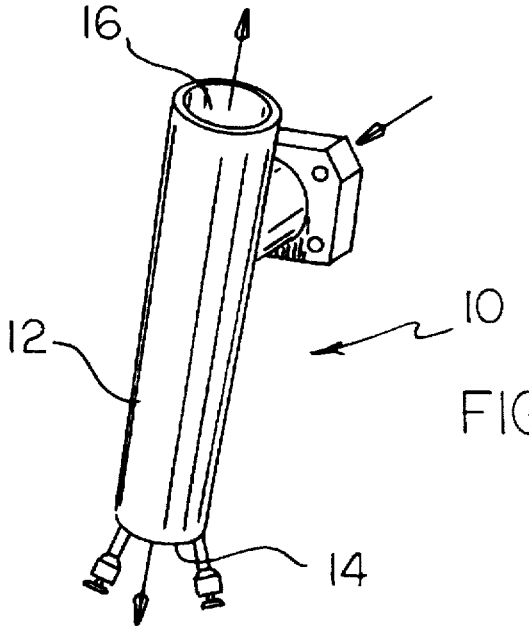
FIG. 1 is a perspective illustration of the preferred embodiment of the golf ball sizing apparatus constructed in accordance with the principles of the present invention.
Figure 2:
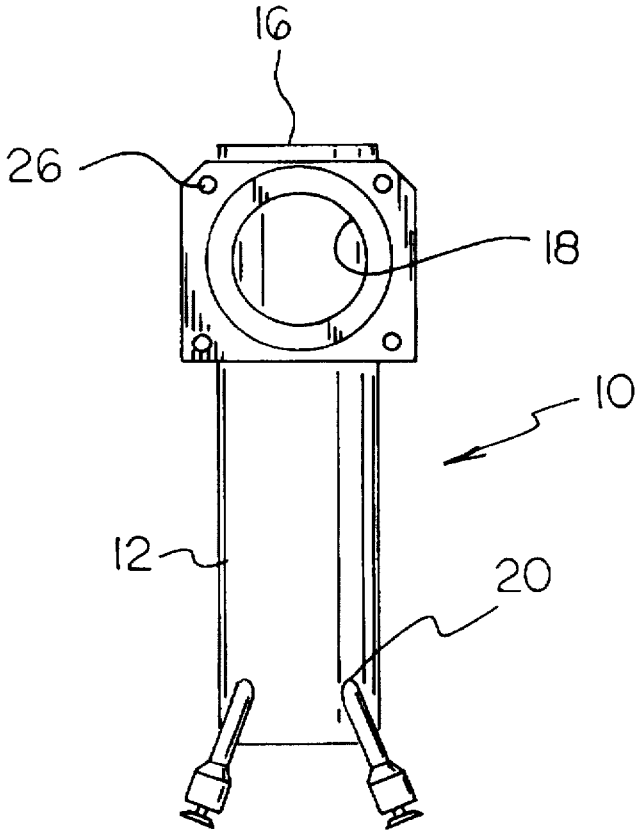
FIG. 2 is a bottom view of the apparatus shown in FIG. 1.
Figure 3:
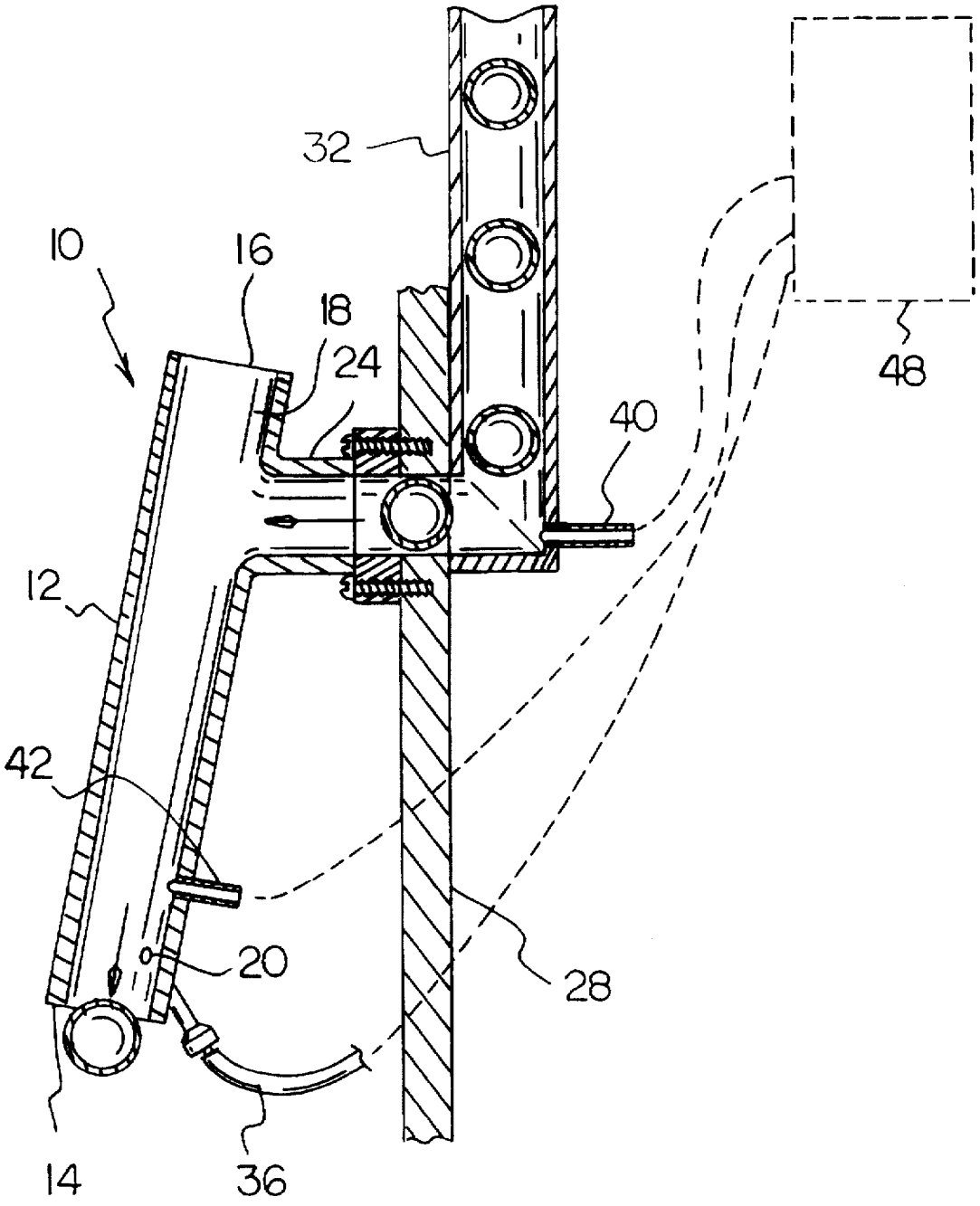
FIGS. 3 and 4 are cross sectional views taken centrally through a vertical cut line of the apparatus shown in the prior FIGS. 1 and 2 illustrating the movement of golf ball therethrough.
Figure 4:
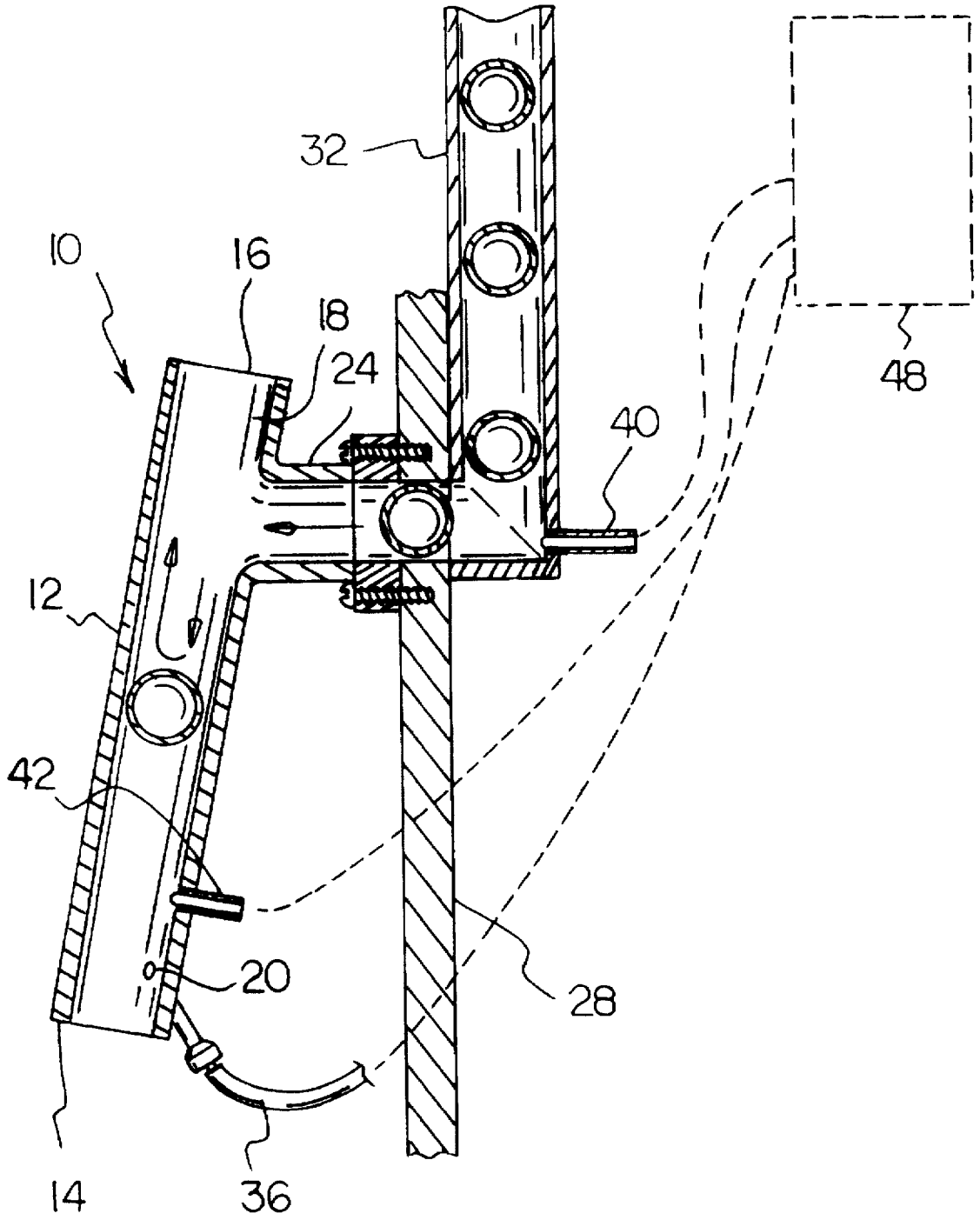

With reference now to the drawings, and in particular to FIG. 1 thereof, a new and improved golf ball sizing apparatus embodying the principles and concepts of the present invention and generally designated by the reference numeral 10 will be described.

The present invention, the new and improved golf ball sizing apparatus, is comprised of a plurality of components. Such components in their broadest context include a first elongated cylinder, a short delivery cylinder, an input ramp, a source of compressed air and sensors. Such components are individually configured and correlated with respect to each other so as to attain the desired objective.

The central component of the system 10 of the present invention is a first elongated cylinder 12. Such cylinder has a primary axis. Such axis is positioned at an angle of about 10 degrees with respect to the horizontal. The angling of the axis and the cylinder thus provides the elongated cylinder with a lower end 14 which is open and an upper end 16 which is also open. The interior diameter of the elongated cylinder throughout the majority of its extent, including the lower extent, is about 2.25 inches. This allows for the rolling of golf balls of a first set to move therethrough and out of the lower end. By golf balls of the first set it is meant golf balls which meet predetermined specifications including size, burrs, blisters and long gates. Golf balls of the second set are those which do not meet such specifications. The golf balls of such second set are unacceptable.

Next formed in the elongated cylinder is a large aperture 18. Such aperture is formed in an upper surface of the elongated cylinder at a central extent thereof. Such aperture forms a long lower region in the elongated cylinder therebeneath as well as a short upper region at the elongated cylinder thereabove. The interior surface of the elongated cylinder is of an increasing diameter from the central extent adjacent to the large aperture to the upper end of the elongated cylinder.

A pair of supplemental small apertures 20 are also formed in the upper surface of the elongated cylinder in a region offset from the uppermost region thereof. The supplemental small apertures are formed at an angle of about 35 degrees with regard to the axis of the elongated cylinder.

The next major component of the system 10 is a short delivery cylinder 24. Such short cylinder has a vertical axis with a diameter of about 2.76 inches. The short delivery cylinder is formed with its lower end coupled to or, preferably, formed integrally with, the first elongated cylinder at the large aperture. The short delivery cylinder has an upper end formed with a flange 26. Such flange has corner apertures for coupling with the machine 28 through appropriate bolts to permit the delivery of golf balls at a predetermined feed rate, normally one golf ball each 1.5 seconds, wherein such fed golf balls are to be separated between acceptable and unacceptable golf balls. A feeder 32 is formed above the short delivery system to allow movement of golf balls from the fabrication machine to the sizing system. Such ramp functions for delivering golf balls into the delivery system at a predetermined fixed rate of flow.

In order to function for the golf ball separating function, there is provided a source 36 of compressed air with a release valve. Such source is coupled through appropriate lines to the small apertures near the lower end of the first elongated cylinder. Such lines are adapted to inject a stream of air into the elongated cylinder upon activation of the valve. Such injection is in a direction toward the upper end of the elongated cylinder. Such stream of air will function to drive a golf ball of the second set, which due to an imperfection cannot roll down to the lower end of the elongated cylinder, upwardly and outwardly of the elongated cylinder after it has failed to move out of the lower end of the elongated cylinder.

Operation and use is effected through the incorporation of a pair of sensors 40, 42. Such sensors are preferably optical sensors with associated fiber optic components. One of the sensors 40 is located adjacent to the upper end of the delivery cylinder. Such will sense the passage of a ball B at a predetermined time sequence entering the top of the short delivery system for passage into the elongated cylinder wherein a properly sized ball of the first set will roll downwardly and out of the bottom of the first elongated cylinder. The other sensor 42 is located in a hole in the first elongated cylinder adjacent to a central extent where it will identify the passage of properly sized golf balls of the first set therepast at the predetermined time. The sensors are coupled through a processor 48 which will maintain a track of the balls down the ramp 32, through the short delivery system 24 and then through the first elongated cylinder. In the event that a ball does not reach the sensor 42 in a properly timed fashion as determined by the micro processor, such will identify the situation as a golf ball of the second set, one of unacceptable specifications. The micro processor will then activate the valve associated with the source of compressed air in the event that the golf ball of the second set has not moved through the lower end of the elongated cylinder in a timely manner. The flow of air will drive such golf ball of the second set upwardly and out of the elongated cylinder as a reject. A bucket or other container may be placed beneath the upper and lower ends of the elongated cylinder to sort and collect separated golf balls of the two sets.

The cylinders are preferably fabricated of cylindrical stock with a precise hole honed through it. The length to be determined by the diameter of the ball times 3.1417. In this case, about 8 inches long. A hole is bored in the side wall to allow the ball to enter it for being sized. The ball sizer is pitched at a 10 degree angle, allowing the ball to roll through it. While rolling, the ball is being checked for burrs, blisters, long gates, etc. If the ball has any of these conditions, it will stop rolling in the ball sizer when the condition hits the outside wall. Under such circumstances, the sensors will activate a flow of compressed air upwardly through the cylinder to drive the unacceptable ball upwardly and out of the elongated cylinder through its upper end for separation from the stream of acceptable golf balls.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus for separating a flow of golf balls into a first set of golf balls which meet predetermined specifications and a second set of golf balls which do not meet specifications comprising:

a first elongated cylinder having a central axis positioned at an angle with respect to the horizontal, the elongated cylinder having an open lower end and an open upper end in coaxial alignment with the lower end and having an interior diameter to allow for the rolling of golf balls of the first set to move therethrough and out of the lower end, a large aperture formed in an upper surface of the elongated cylinder at a central extent thereof, the interior surface of the elongated cylinder being of an increased diameter between the central extent thereof and the upper end thereof, a supplemental small aperture formed in the upper surface of the elongated cylinder offset from the uppermost extent thereof, the supplemental small aperture being formed at an angle with regard to the axis of the elongated cylinder;

a short delivery cylinder having a vertical axis and being formed with a lower end coupled to the large aperture and an upper end for delivering golf balls to be separated; and a source of compressed fluid coupled to the small aperture adapted to inject a stream of fluid into the elongated cylinder in a direction toward the upper end to drive a golf ball of the second set in the elongated cylinder outwardly of the elongated cylinder.

2. An apparatus for separating a flow of golf balls into a first set of golf balls which meet predetermined specifications and a second set of golf balls which do not meet specifications comprising:

a first elongated cylinder having a central axis positioned at an angle with respect to the horizontal, the elongated cylinder having an open lower end and an open upper end and having an interior diameter to allow for the rolling of golf balls of the first set to move therethrough and out of the lower end, a large aperture formed in an upper surface of the elongated cylinder at a central extent thereof, the interior surface of the elongated cylinder being of an increased diameter between the central extent thereof and the upper end thereof, a supplemental small aperture formed in the upper surface of the elongated cylinder offset from the uppermost extent thereof, the supplemental small aperture being formed at an angle with regard to the axis of the elongated cylinder;

a short delivery cylinder having a vertical axis and being formed with a lower end coupled to the large aperture and an upper end for delivering golf balls to be separated;

a source of compressed fluid coupled to the small aperture and adapted to inject a stream of fluid into the elongated cylinder in a direction toward the upper end to drive a golf ball of the second set in the elongated cylinder outwardly of the elongated cylinder; and sensor means for sensing the flow of golf balls of the first set through the lower end of the elongated cylinder and to activate the source of compressed air in the event that a golf ball of the second set does not move through the lower end of the elongated cylinder in a timely manner to thereby drive such golf ball out of the upper end.

3. An apparatus for separating a flow of golf balls into a first set of golf balls which meet predetermined specifications including size, burrs, blisters and long gates and a second set of golf balls which do not meet specifications comprising, in combination:

a first elongated cylinder having a primary axis positioned at an angle of about 10 degrees with respect to the horizontal, the elongated cylinder having an open lower end and an open upper end and having an interior diameter of about 2.25 inches to allow for the rolling of golf balls of the first set to move therethrough and out of the lower end, a large aperture formed in an upper surface of the elongated cylinder at a central extent thereof to form a long lower region and a short upper region, the interior surface of the elongated cylinder being of an increasing diameter from the central extent thereof to the upper end thereof, a pair of supplemental small apertures formed in the upper surface of the elongated cylinder offset from the uppermost region thereof, the supplemental small apertures being formed at an angle of 30 degrees with regard to the axis of the elongated cylinder;

a short delivery cylinder having a vertical axis and having an diameter of about 2.76 inches and being formed with a lower end coupled to the large aperture of the elongated cylinder and having an upper end with a flange for coupling with a machine for delivering at a predetermined feed rate golf balls to be separated;

a ramp for the delivering of golf balls into the delivery cylinder;

a source of compressed air coupled to the small apertures adapted to inject a stream of air into the elongated cylinder in a direction toward the upper end of the elongated cylinder to drive a golf ball of the second set in the elongated cylinder outwardly of the elongated cylinder; and a sensor adjacent to the output end of the elongated cylinder to sense the flow of golf balls of the first set through the lower end of the elongated cylinder and to activate the source of compressed air in the event that a golf ball of the second set does not move through the lower end of the elongated cylinder in a timely manner to thereby drive such golf ball out of the upper end.

* * * * *